US005121839A

United States Patent [19]

Lapp

[11] Patent Number: 5,121,839

[45] Date of Patent: Jun. 16, 1992

[54] DISPENSING CARTON WITH A FRONT ROLL-ENGAGING TAB

[75] Inventor: Joan K. Lapp, Hope, Mich.

[73] Assignee: The Dow Chemical Company, Midland, Mich.

[21] Appl. No.: 620,946

[22] Filed: Dec. 3, 1990

[51] Int. Cl.[5] ..... B65D 85/67

[52] U.S. Cl. ..... 206/408; 206/395; 225/48

[58] Field of Search ..... 206/389, 395–397, 206/408; 225/48–50

[56] References Cited

U.S. PATENT DOCUMENTS

| | | | |
|---|---|---|---|
| 1,717,613 | 6/1929 | Meyer . | |
| 1,855,854 | 4/1932 | Gardner | 225/50 |
| 1,885,996 | 11/1932 | Duffin . | |
| 2,000,867 | 5/1935 | Spaldo | 225/48 |
| 2,115,867 | 5/1938 | McConnell . | |
| 2,189,533 | 2/1940 | Harvey . | |
| 2,302,253 | 11/1942 | Broeren | 225/48 X |
| 2,458,844 | 6/1949 | Danenbauer | 225/50 X |
| 2,463,375 | 3/1949 | Gluck . | |
| 2,474,783 | 6/1949 | Gluck | 225/50 |
| 2,624,521 | 1/1953 | Broeren | 206/395 |
| 2,683,529 | 7/1954 | Wanda | 225/50 |
| 2,713,939 | 7/1955 | Lear | 225/50 |
| 2,803,339 | 8/1957 | Kuchenbecker | 206/396 |
| 3,246,742 | 4/1966 | Coe | 206/396 |
| 3,281,034 | 10/1966 | Woodling . | |
| 4,648,536 | 3/1987 | VanderLugt . | |
| 4,714,191 | 12/1987 | Richardson . | |

*Primary Examiner*—Bryon P. Gehman

[57] ABSTRACT

An improved foldably erect dispensing carton particularly for household wrapping materials such as polymeric films and the like, wherein the carton embodies a tab along a longitudinal axis of the front panel about midway longitudinally in the front panel providing an opening therein. The tab is hingedly connected along a hinged line to the front panel, and when operative, has a free end adapted to be disposed inwardly into the carton towards the top of the lid above the hinge line between the lead edge of the material and the roll of the material to prevent withdrawal of the lead edge back onto the roll.

11 Claims, 3 Drawing Sheets

DISPENSING CARTON WITH A FRONT ROLL-ENGAGING TAB

BACKGROUND OF THE INVENTION

This invention relates to an improved dispensing carton for sheet materials supplied in roll form, particularly polymeric film and like wrapping materials for household and other uses. Particularly, the invention relates to a dispensing carton wherein the improvement resides in a feature which is adapted to be disposed between the lead edge of the material and the roll of the material to prevent withdrawal of the lead edge back onto the roll.

A problem associated with dispension of polymeric films is that the lead edge of the film after the roll is started, is usually not adequately prevented from being rolled back onto the roll and back into the carton. This problem is frequently encountered in case of films which have a "tacky" surface character resulting in the lead edge of the film being lost due to its adherence to itself on the roll. When such loss occurs customers generally suffer some frustration before they are able to retrieve the lead edge.

The primary object of the present invention is to provide an improved dispensing carton for a roll of sheet material having a practical, effective and inexpensive improvement feature for preventing return of lead portion of the sheet material back into the carton, with the feature being compatible with the manufacture, printing, erecting and the loading of the carton at commercially acceptable speeds.

It is still another objective of this invention to provide such a carton wherein the retaining feature can be included in the carton design with minimum change required in existing production equipment, and with near certain reliability.

SUMMARY OF THE INVENTION

The present invention is directed towards an improved dispensing carton being generally rectangular in shape with a means for providing an exit opening for dispensing the material and means for cutting the roll material in desired lengths. The improvement resides in a tab, preferably formed out of the front panel itself, along a longitudinal axis of the carton's front panel about midway longitudinally in the front panel providing an opening therein, having a free end of the tab adapted to extend inwardly into the carton toward the top of the lid of the carton when operative. The tab, when operative, is disposed between the lead edge of the material and the roll of the material to prevent withdrawal of the lead edge back on to the roll. In addition, the tab being pushed in and over the roll in the dispenser puts pressure on the roll so that it is less likely for the roll to pop out of the box while a portion of the film is being dispensed. Furthermore, the opening formed in the front panel of the carton when the tab is operative, provides for an easy pick up of the lead edge of the film to facilitate its dispensation. Still furthermore, should the edge of the film tend to get "lost" onto the roll inside the container, the tab reverses the direction of the edge so that it gets folded back onto itself instead of on the roll forming a folded edge with double the thickness of the film, thereby making it easier to pick it up and restart the dispensation of the film as needed.

The invention will be more apparent by reference to the following detailed description when taken in view of the accompanying drawings depicting a preferred embodiment wherein.

DESCRIPTION OF THE INVENTION

Figure 1:
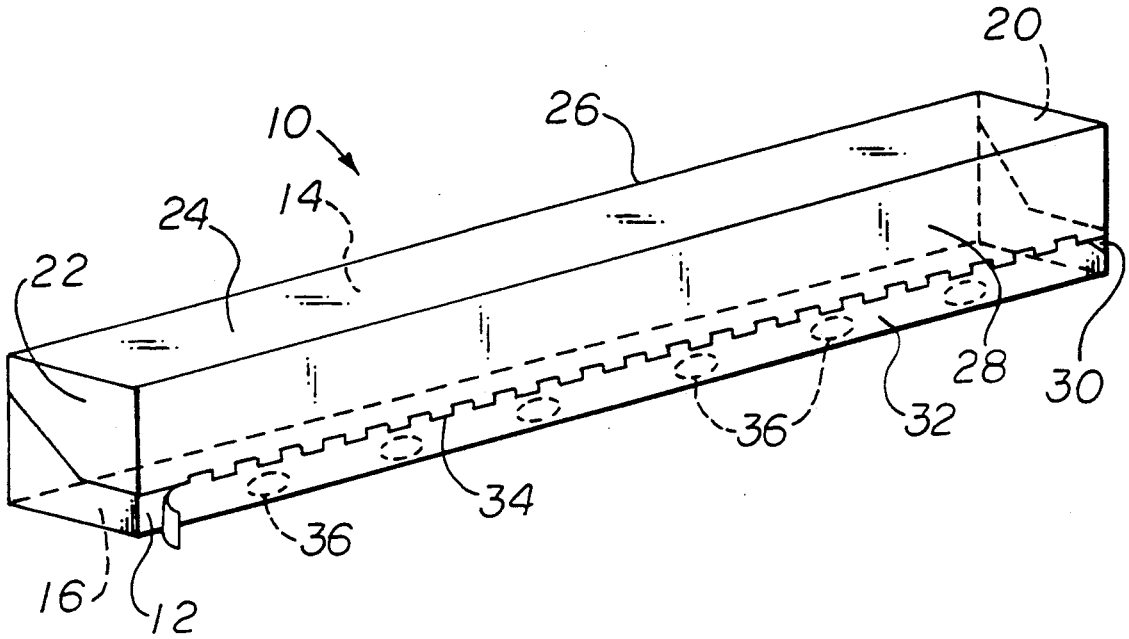
FIG. 1 is a front isometric view of a dispensing carton when the carton is closed in the form as it would be provided to the customer.

Referring now to FIG. 1, there is illustrated a dispensing carton 10 in its erected form showing a front panel 12, a rear panel 14, a bottom panel 16 and end panels 18 and 20 foldably connected to one another, a trunk lid 22 having a top panel 24 hingedly connected to the rear panel along hinge line 26. A front flange 28 extends downward from the top panel of the lid overlapping a portion of the front panel when the carton is in closed position. The lower extension of the front flange presents an edge 30, and a tear strip 32 detachably secured to the edge along a weakened line 34. The tear strip overlies a cutter bar 46 (see FIG. 2) and is glued to the front panel along glue spots 36 when an unopened carton is first received by the customer.

Figure 2:
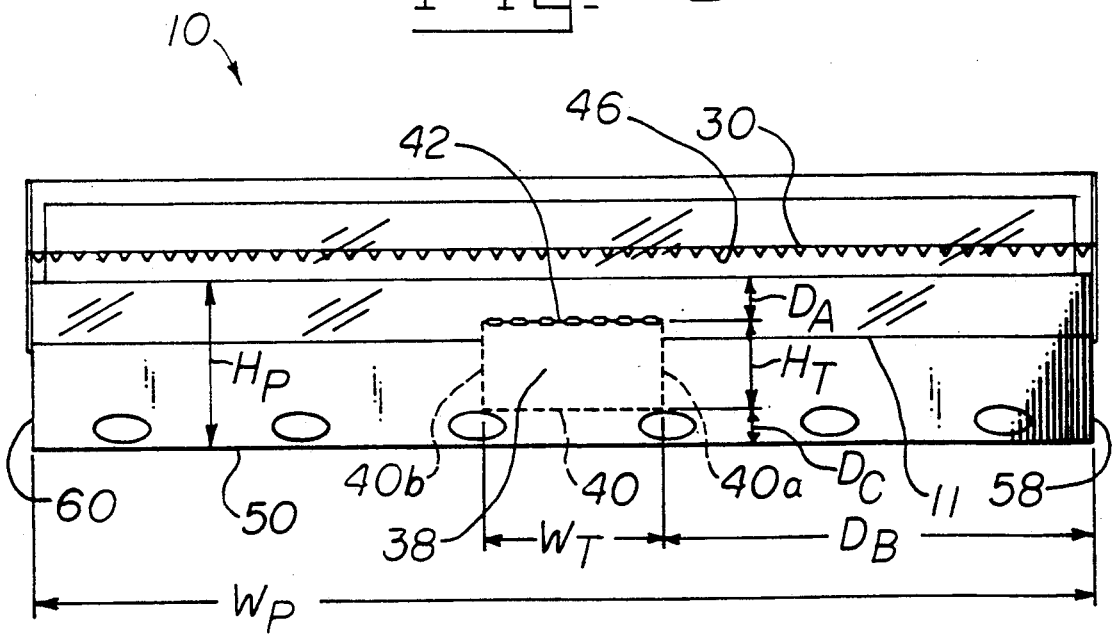
FIG. 2 is a front elevational view of the carton when the carton has been opened, and the tab is yet inoperative.

Upon removal of the tear strip see FIG. 2), the lid is free to be opened with the cutter bar 46 secured to the edge 30 of the lower extension of front flange. A generally rectangular tab 38 located along a longitudinal axis of the carton's front panel about midway longitudinally in the front panel, in inoperative position, is exposed in the front panel and is preferably formed out of the front panel itself.

The invention particularly resides in the character of the tab 38 and its operation. The tab comprises a lower edge 40 with two generally parallel side edges **40*a* and 40*b*, and an upper edge 42 (see FIG. 2). The lower edge 40 defines a free end 40' of the tab 38 when separated from the panel (see FIG. 3). The upper edge 42 and the lower edge 40 of the tab each has a width "$W_T$" from about one-tenth to about nine-tenths of the width "$W_P$" from ends 58 and 60 of the front panel 12. The parallel side edges 40*a* and 40*b* have the height "$H_T$" from about one-half to about three quarters of the height "$H_P$" of the front panel 12. In a more preferred embodiment, the upper edge 42 can be located downward from an upper edge 48 (see FIG. 4 and 5) of the front panel at a distance $D_A$ of about three-eighths to about three-sixteenths of the height of the front panel, the lower edge 40 is located upwards from a lower edge 50 (see FIGS. 2) of the front panel a distance $D_C$ of about one-sixteenth to about one-eighth of the height $H_P$ of the front panel, each side edge is located at a distance DB of about two-fifths of the width $W_P$ of the front panel from its nearest end 58 or 60** of the front panel respectively.

In the most preferred embodiment as illustrated in the FIGS. 2 through 5, the upper edge 42 is located downward from an upper edge 48 (see FIG. 4 and 5) of the front panel at a distance $D_A$ of about three-eighths of the height of the front panel, the lower edge 40 is located upwards from a lower edge 50 (see FIGS. 2) of the front panel a distance $D_C$ of about one-eighth of the height $H_P$ of the front panel, each side edge is located at a distance $D_B$ of about nine-twentieths of the width $W_P$ of the front panel from its nearest end 58 or 60 of the front panel respectively.

In the inoperative tab position as shown in FIG. 2, the lower edge and the two lateral parallel edges are perforated along their lines and the upper edge is scored along its line so as to be hingedly connected to the front panel when the tab is in operative position and is defined the hinged end.

The dispensing container can optionally have a cling coating or tack adhesive 11 as seen in FIG. 2 extending downward from the upper edge 48 of the front panel 12, at a distance of about three-eighths the height $H_P$ of the front panel, extending longitudinally from one end 58 to another end 60 of the front panel. The cling strip serves to keep the lead edge 54 of the roll 56 of the material 52 clinging to the front panel of the carton.

Figure 3:
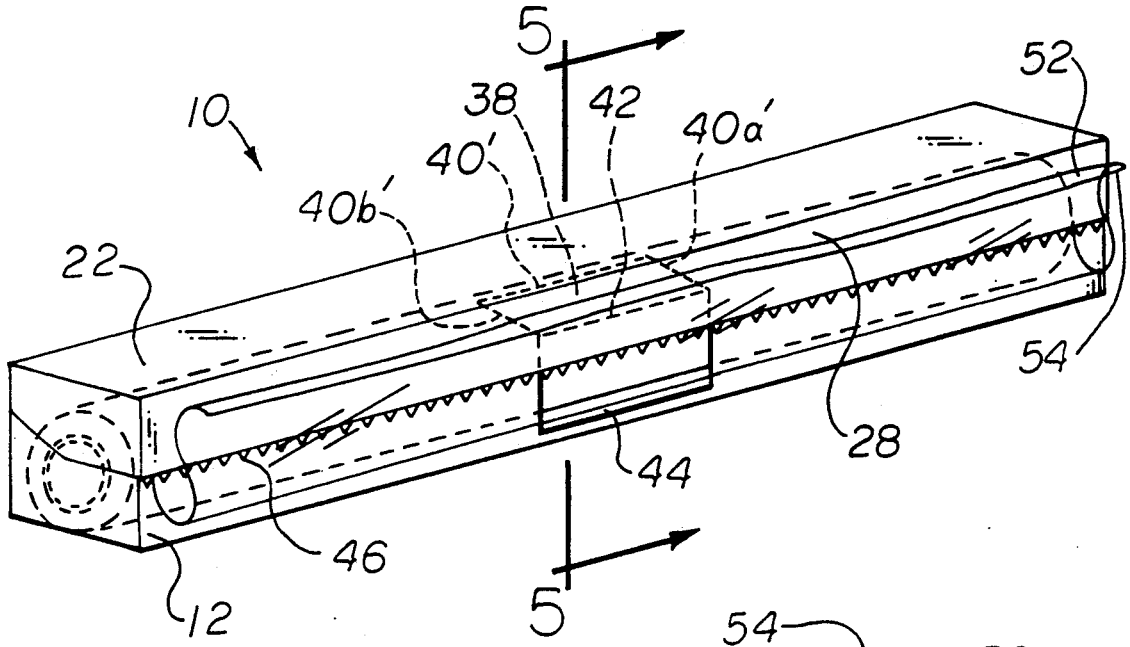
FIG. 3 is a front elevational view of the carton when the carton has been opened, and the tab is operative while the carton lid is closed.
Figure 4:
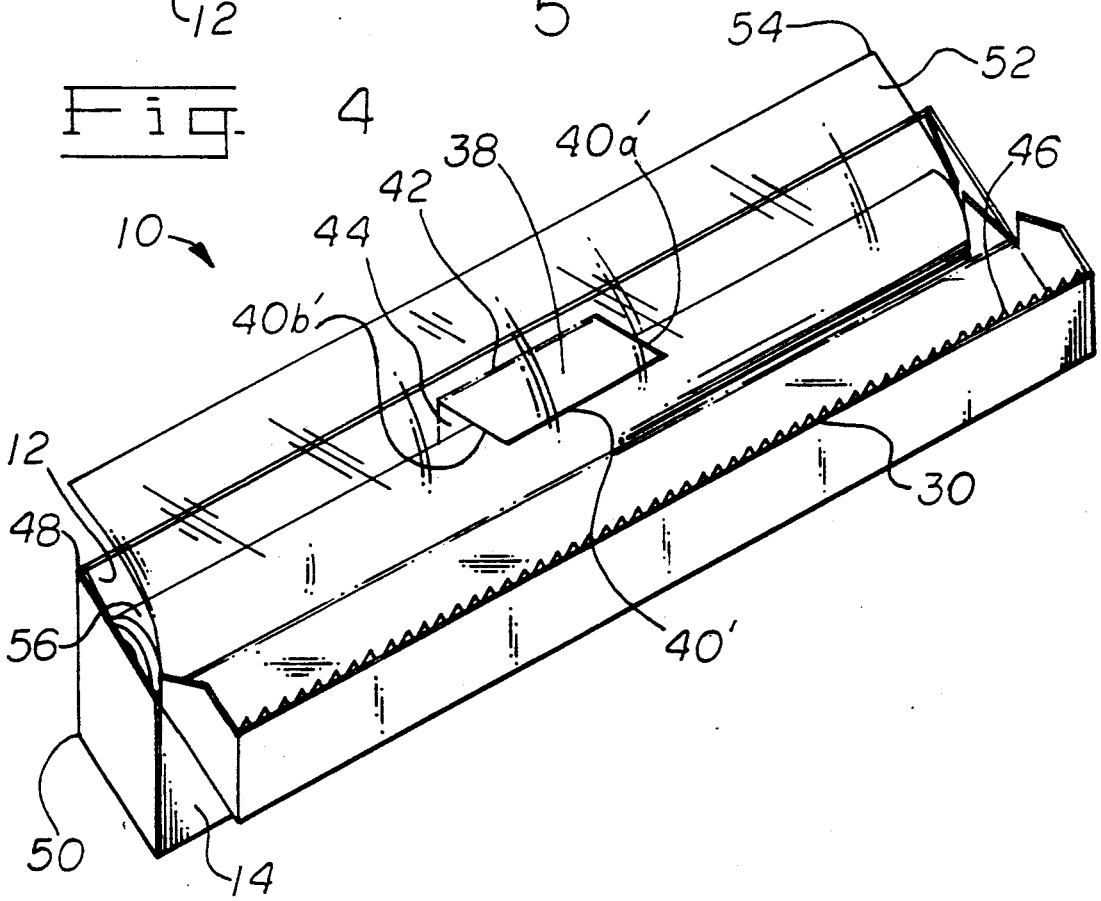
FIG. 4 is a view of the carton taken from the top with lid open enough to show the tab when operative and adapted to be dispensed between the lead edge of the film and the roll.
Figure 5:
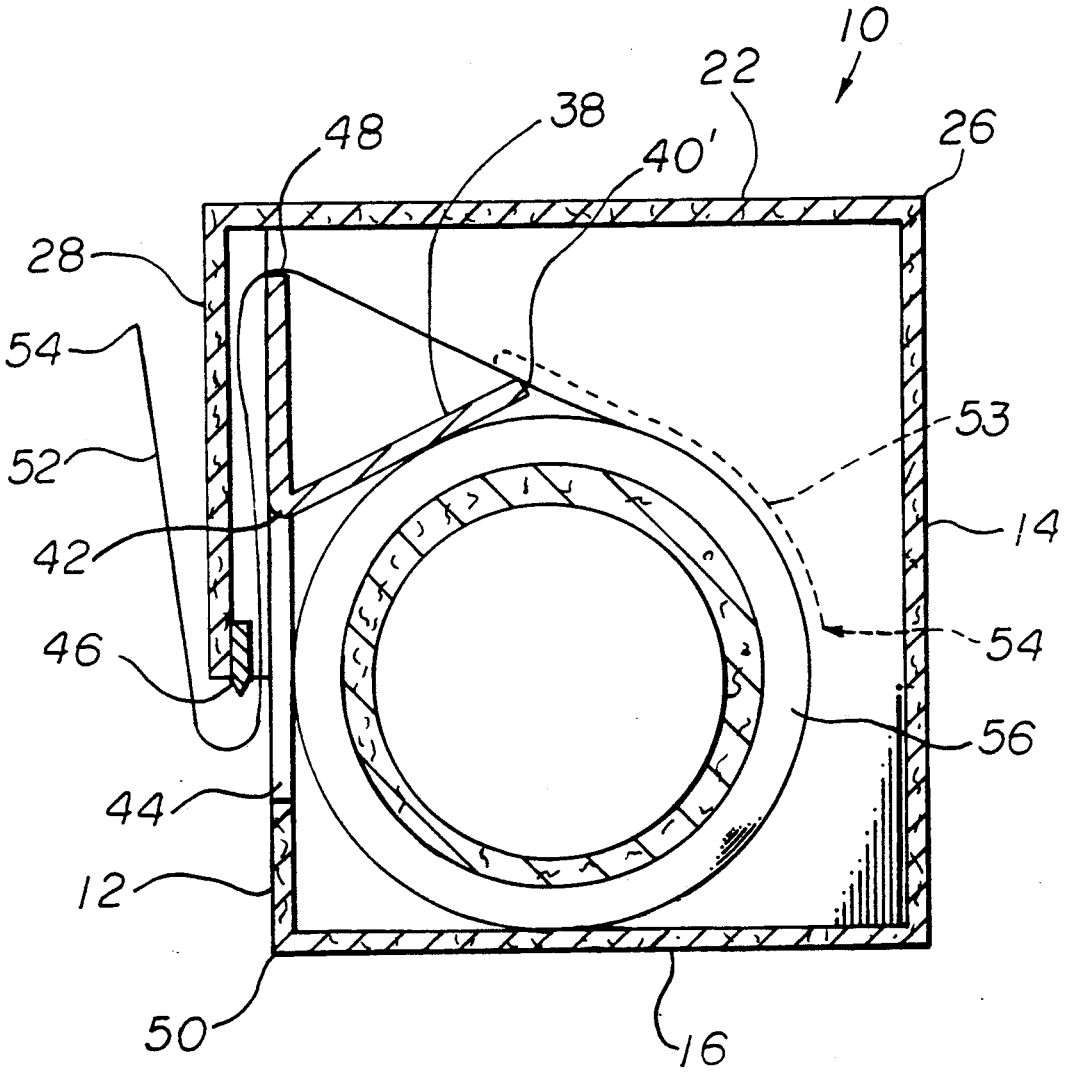
FIG. 5 is a cross sectional view through FIG. 3 taken along reference line 5—5 thereof.

FIGS. 3 to 5 illustrate the carton when the tab 38 is pushed into the carton interior to be disposed between the lead edge 54 of the material 52 and the roll 56 of the material 52 , and at the same time puts pressure against the roll biasing it towards the bottom panel 16 of the carton to prevent the roll 56 from popping out of the carton. The front panel presents an opening 44 formed by the punching open of tab 38 revealing the enclosed roll of the material when the tab is operative.

FIGS. 4 and 5 most specifically illustrate the tab 36 in operative position and being disposed between the lead edge 54 of the material 52 and the roll 56 of the material to prevent the withdrawal of the lead edge back onto the roll. Front panel 12 terminates at an upper edge 48 and a lower edge 50 as best seen in FIG. 5. The upper edge 48 of the front panel in cooperation with the front flange 28 of the lid 22 defines an opening through which the material 52 exits when ready to be dispensed. FIG. 5 further illustrates the path the film traverses when being disposed from the carton.

In the operation of this invention, tear strip 32 is torn off along the weakened line 34, thereby exposing the cutter bar 46 secured along the edge 30 of the front flange 28. The tab 38 is punched inwardly to the interior of the carton along the perforated edges 40, 40*a* and 40*b*, exposing free end 40′, and two generally parallel lateral edges 40*a*′ and 40*b*, respectively. The free end 40′ of tab 38 is extended inwardly into the carton towards the top 24 of the lid 22 above hinge line 42 (see FIG. 2) so that it urges the lead edge 54 of the material 52 up from the roll 56, at the same time restraining the roll and keeping it from popping out of the carton while the material is being dispensed from the carton as previously described. After the first desired length of the material is dispensed through the opening, the tab is wedged between the lead edge 54 of the material 52 and the roll 56 of the material. The tab in this operative position embraces the roll, at the same time lifting the lead edge 54 of the material 52 up and away from the roll 56, thereby facilitating subsequent dispensation of the material from the carton without the lead edge 54 rolling back onto itself on the roll 56 or the roll 56 popping out of the carton.

The tab 38 also operates to reverse the direction of the lead edge 54 of the material 52 so that the lead edge 54 folds back onto itself resulting in a folded edge 62 now having double the thickness of the material 52 (shown in broken lines in FIG. 5), making it easier to retrieve folded lead edge, should the lead edge tend to get "lost" back onto the roll inside the container. The tab accommodates for decrease in the diameter of the roll as material is dispensed thereof without any loss in its effectiveness.

Opening 44 in cooperation with the cling coating 11 provides for an easy pick up of the lead edge 54 of the material 52 and further facilitates the dispensation of the material.

While the preferred embodiment of the invention is shown with regard to specific details in carton designs, it will be appreciated that depending upon the carton design and the manufacturer's desires, the invention may be modified by various changes while still being fairly within the scope of the general teachings and principles hereof.

What is claimed is:

1. An improved dispensing carton containing roll material, comprising:

a. front, rear, bottom and end panels, the front panel having an upper edge and a lower edge defining the height of the front panel therebetween, and two opposing ends defining the width of the front panel therebetween;

b. a lid in cooperative combination with the panels forming a generally elongated rectangular box in which a roll of material is contained; and c. a tab in the front panel about midway along the width of the front panel, the tab generally having an upper edge, a lower edge and opposite side edges, the upper edge defining a hinged end being hingedly connected along a hinge line to the front panel, the tab disposed inwardly into the carton towards the top of the lid above the hinged end between a lead edge of the material and the roll to prevent withdrawal of the lead edge back onto the roll.

2. The carton of claim 1, wherein the tab is elongated.

3. The carton of claim 1, wherein the tab is generally rectangular and its sides edges are generally parallel.

4. The carton of claim 3, wherein the tab side edges have a height from about one-half to about three-fourths of the height of the front panel and the upper and the lower tab edges have a width from about one-tenth to about nine-tenths the width of the front panel.

5. The carton of claim 1, wherein the hinged end is located downward from the upper edge of the front panel a distance of about three-eighths to about three-sixteenths of the height of the front panel, the tab lower edge is located upwards from the lower edge of the front panel at a distance of about one-sixteenth to one-eight the height of the front panel, the tab side edges being at a distance of about two-fifths the width of the front panel from the nearest end of the front panel respectively.

6. The carton of claim 1, wherein the lower edge and the side edges of the tab are punched in, and the upper edge is hingedly connected to the front panel.

7. An improved dispensing carton for roll material, comprising:

a. front, rear, bottom and end panels, the front panel having an upper edge and a lower edge defining the height of the front panel therebetween, and two opposing ends defining the width of the front panel therebetween;

b. a lid in cooperative combination with the panels forming a generally elongated rectangular box; the lid being a trunk lid having a top panel hingedly connected to the rear panel along a hinge line, a front flange extending downward from the top panel of the lid overlapping a portion of the front panel when the carton is in closed position, the front flange in cooperation with the upper edge of the front panel defining an opening through which the material exits when ready to be dispensed, the lower extension of the flange presenting an edge and a tear strip detachably secured to the edge along a weakened line, the tear strip being glued to the front panel along plurality of glue spots when the carton is in closed position; and a tab in the front panel about midway along the width of the front panel, the tab generally having an upper edge, a lower edge and opposite side edges, the upper edge defining a hinged end being hingedly connected along a hinge line to the front panel, the tab adapted to be disposed inwardly into the carton toward the top of the lid above the hinged end between a lead edge of the material and the roll to prevent withdrawal of the lead edge back onto the roll.

8. The carton of claim 7, wherein the tear strip extends downwardly from the edge of the lower extension of the front flange almost to the lower edge of the front panel overlying a cutter bar extending along the edge of the lower extension of the front panel from one end of the container to the other, the tear strip enclosing the tab when both the tear strip and the tab are intact.

9. The carton of claim 7, wherein said tab is generally rectangular and its side edges are generally parallel.

10. The carton of claim 9, wherein the tab side edges have a height from about one-half to about three-fourths of the height of the front panel and the upper and the lower tab edges have width from about one-tenth to about nine-tenths the width of the front panel.

11. The carton of claim 10, wherein the hinged end is located downward from the upper edge of the front panel a distance of about three-eighths to about three-sixteenths the height of the front panel, the tab lower edge is located upwards from the lower edge of the front panel at a distance of about one-sixteenth to one-eighth the height of the front panel, the tab side edges being at a distance of about two-fifths the width of the front panel from the nearest end of the front panel respectively.

* * * * *